United States Patent [19]

Brendel

[11] 4,240,263

[45] Dec. 23, 1980

[54] REFRIGERATION SYSTEM - METHOD AND APPARATUS

[75] Inventor: Thomas E. Brendel, Fayetteville, N.Y.

[73] Assignee: Carrier Corporation, Syracuse, N.Y.

[21] Appl. No.: 35,742

[22] Filed: May 3, 1979

[51] Int. Cl.[3] ..... F25B 1/00

[52] U.S. Cl. ..... 62/115; 62/199; 62/512

[58] Field of Search ..... 62/197, 199, 512, 115

[56] References Cited

U.S. PATENT DOCUMENTS

| | | | |
|---|---|---|---|
| 2,576,663 | 11/1951 | Atchison | 62/199 |
| 2,791,101 | 5/1957 | Zearfoss, Jr. | 62/512 |
| 3,003,332 | 10/1961 | Watkins | 62/512 |
| 3,150,502 | 9/1964 | Tucker | 62/197 |
| 3,218,819 | 11/1965 | Crotser | 62/197 |
| 3,434,299 | 3/1969 | Nussbaum | 62/199 |
| 3,577,742 | 5/1971 | Kocher | 62/199 |
| 3,779,031 | 12/1973 | Akiyama et al. | 62/199 |
| 4,012,921 | 3/1977 | Willitts et al. | 62/199 |

*Primary Examiner*—Ronald C. Capossela
*Attorney, Agent, or Firm*—J. Raymond Curtin; John S. Sensny

[57] ABSTRACT

A refrigeration system including a first evaporator having a capillary type expansion device controlling the flow of refrigerant thereto and a second evaporator having a thermal expansion valve for controlling the flow of refrigerant thereto. The system further includes a refrigerant compressor for discharging high pressure refrigerant vapor and a refrigerant condenser for receiving the high pressure refrigerant vapor and for converting the vaporous refrigerant to a relatively high pressure mixture of liquid and vaporous refrigerant. The system further includes a separator for receiving the relatively high pressure mixture from the condenser and for separating a substantial portion of the liquid refrigerant from the vapor liquid mixture. A first conduit is connected to the separator for delivering the separated liquid refrigerant to the thermal expansion valve and a second conduit is provided for delivering the remainder of the vapor liquid mixture to the capillary type expansion device.

4 Claims, 1 Drawing Figure

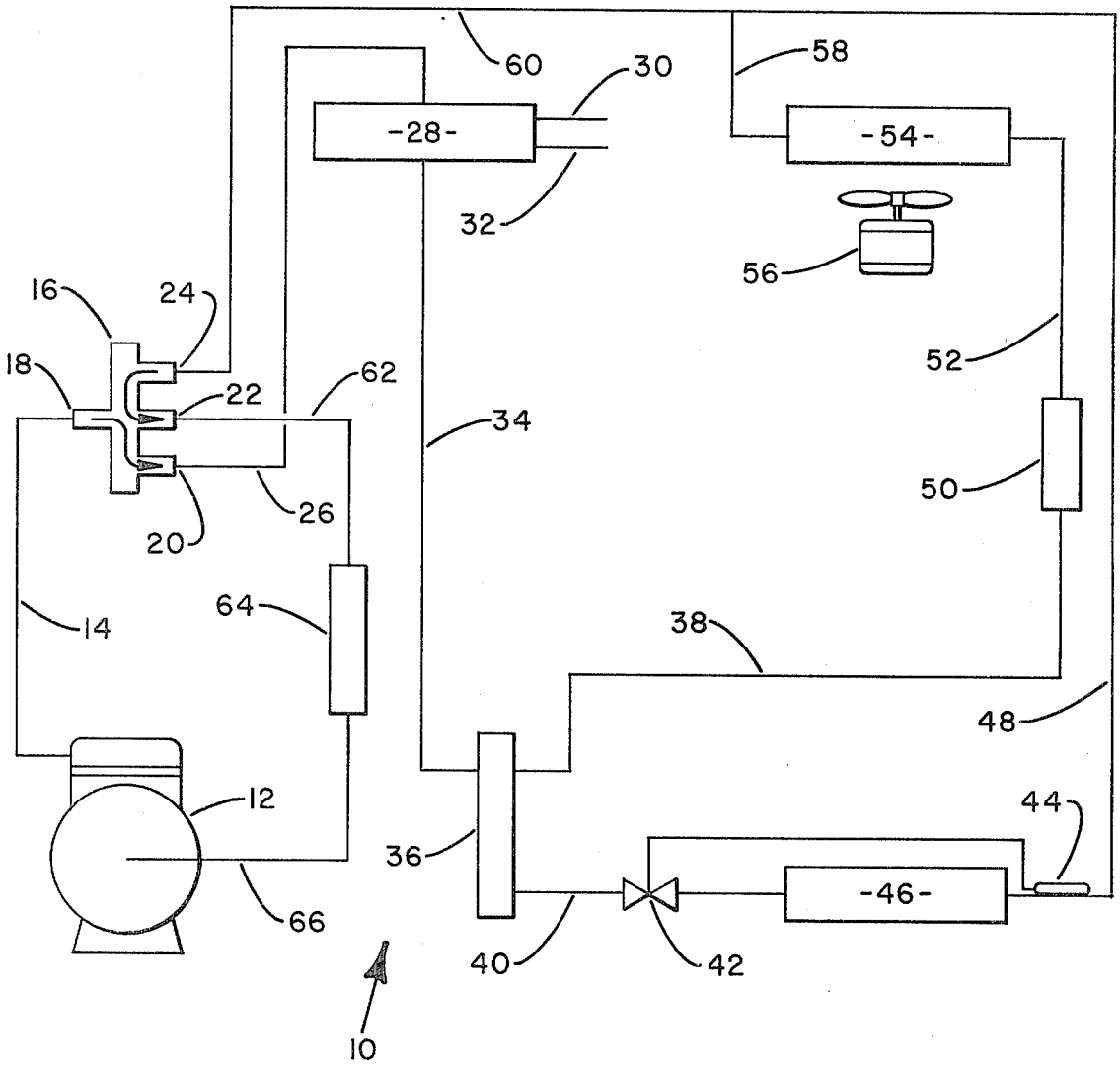
60
30
58
-28-
-54-
32
56
16
24
52
18
22
62
34
50
26
20
64
14
38
48
12
44
36
-46-
66
40
42
10

REFRIGERATION SYSTEM - METHOD AND APPARATUS

BACKGROUND OF THE INVENTION

This invention relates to a refrigeration system, and in particular, to a system having at least two evaporators served by a common refrigerant compressor whereat different forms of expansion devices are employed to control the flow of refrigerant to each of the evaporators.

In some refrigeration systems it is at times necessary to have a single compressor connected to at least two evaporators having different refrigeration loads thereon. Essentially, the single refrigerant compressor provides vaporous refrigerant to a single condenser, with the high pressure liquid formed in the condenser flowing to the multiple evaporators of the system.

In some applications, it is desirable to employ a fixed-orifice or capillary type expansion device for controlling the flow of refrigerant to the evaporator whereas in other applications it is desirable to employ a thermal expansion valve for controlling the flow of refrigerant. Each of the two types of expansion devices provides different benefits and also has different operating characteristics. As used herein the terms "fixed-orifice" or "capillary type" shall be considered as describing equivalent devices since both of these expansion devices function in substantially the same manner within the systems of the type falling within the scope of the present invention.

For example, a thermal expansion valve cannot tolerate any refrigerant vapor bubbles in the flow of refrigerant therethrough. Essentially, liquid refrigerant having entrained vapor bubbles results in a thermal expansion valve operating in a totally inefficient manner.

A fixed-orifice expansion device functions to change the high pressure, high temperature refrigerant upstream thereof into low pressure, low temperature refrigerant downstream thereof. The quantity of refrigerant passing through the capillary expansion device is primarily dependent upon the pressure differential of the refrigerant across the device.

As the refrigeration load on the evaporator associated with the fixed-orifice expansion device decreases, the device tends to permit excessive refrigerant flow to the evaporator resulting in incomplete vaporization of the refrigerant exiting the evaporator. An accumulator is utilized to collect the liquid refrigerant leaving the evaporator. Eventually, a sufficient quantity of refrigerant will be gathered in the accumulator whereby vaporous refrigerant bubbles will be entrained in the refrigerant exiting from the condenser. The entrained bubbles serve an important function. The bubbles throttle the flow of refrigerant through the fixed-orifice device until an equilibrium or balance is reached between the refrigeration load and refrigerant flow. The vaporous refrigerant bubbles are formed in the refrigerant passing to the capillary type expansion valve device as a result of incomplete refrigerant condensation.

When it is desired to provide a single compression device in association with two or more evaporators, one of which is connected to a capillary expansion device and the other to a thermal expansion device, problems in obtaining overall efficient operation of the refrigeration system are created. The vaporous bubbles formed in the refrigerant mixture delivered from the condenser when the refrigeration load on the system is relatively low will create operating problems if the mixture is delivered to the thermal expansion valve, yet is required to regulate the flow of refrigerant through the capillary expansion device.

SUMMARY OF THE INVENTION

Accordingly, it is an object of this invention to improve refrigeration systems.

It is a further object of this invention to improve performance of refrigeration systems having multiple evaporators served by a single compressor-condenser unit with at least one of the evaporators having a thermal expansion valve controlling the flow of refrigerant thereto and the other of the evaporators having a capillary type expansion valve device controlling the flow of refrigerant thereto.

It is yet another object of this invention to enable a mixture of vaporous and liquid refrigerant to flow to a capillary type expansion device while simultaneously allowing only liquid refrigerant to flow to a thermal expansion valve.

These and other objects of the present invention are attained in a refrigeration system including a first evaporator having a capillary type expansion device controlling flow of refrigerant thereto and a second evaporator having a thermal expansion valve for controlling flow of refrigerant thereto. The system further includes a refrigerant compressor for discharging high pressure refrigerant vapor; and a refrigerant condenser for receiving the high pressure refrigerant vapor and for converting the vaporous refrigerant into a relatively high pressure mixture of liquid and vaporous refrigerant. The system further includes separator means for receiving the relatively high pressure mixture from the condenser and for separating a substantial portion of the liquid refrigerant from the vapor liquid mixture. Discharge means is connected to the separator means and includes a first conduit for delivering the separated liquid refrigerant to the thermal expansion valve and a second conduit for delivering the remainder of the vapor-liquid mixture to the capillary type expansion device.

BRIEF DESCRIPTION OF THE DRAWING

The single FIGURE of the drawing schematically illustrates the present invention.

DESCRIPTION OF THE PREFERRED EMBODIMENT

Referring now to the drawing, there is disclosed a refrigeration system 10 including the present invention. Refrigeration system 10 includes a refrigerant vapor producing device, as for example compressor 12. Compressor 12 may be a reciprocating or centrifugal compressor. High pressure refrigerant vapor produced within compressor 12 is delivered through a conduit 14 to a four-way valve 16. As shown, the high pressure refrigerant vapor flows into inlet 18 of valve 16 and passes therefrom through outlet 20. The high pressure refrigerant vapor thence passes through conduit 26 to a refrigerant condenser 28. A substantial portion of the high pressure vaporous refrigerant is condensed within condenser 28. The amount of uncondensed vaporous refrigerant discharged from condenser 28 is dependent, to a large degree on the mass flow rate of the refrigerant therethrough. Condenser 28 may be either an air-cooled condenser or a water-cooled condenser. When water is employed as the condensing medium, the water is delivered to the condenser through conduit 30 and exits therefrom through conduit 32. The high pressure mixture of liquid and vaporous refrigerant flows from condenser 28 through a conduit 34 to a separator 36. Separator 36 has a first outlet in communication with conduit 38 and a second outlet in communication with conduit 40. The function of separator 36 shall be more fully explained hereinafter.

The refrigerant flowing through conduit 38 is delivered through a capillary type expansion device 50, to a conduit 52 and thence to a refrigeration evaporator 54. A medium to be cooled (for example air) is routed over the surface of evaporator 54 as for example by fan 56. The refrigerant passing through evaporator 54 is vaporized as a result of absorbing heat from the medium passing thereover. The vaporous refrigerant exits from evaporator 54 via conduit 58 and is thence delivered into conduit 60.

The refrigerant passing through conduit 40 is directed to a thermal expansion valve 42 serving as an expansion device for controlling the flow of refrigerant through evaporator 46. Thermal expansion valve 42 includes a sensing bulb 44 provided in heat transfer relation with the refrigerant discharged from evaporator 46 for sensing the temperature of the refrigerant exiting therefrom. As is well known to those skilled in the art, valve 42 is regulated in accordance with the degree of superheat of the refrigerant as sensed by bulb 44. A medium to be cooled is passed over the surface of evaporator 46 by means (not shown) such as a fan similar to the fan 56 hereinabove described. The vaporous refrigerant exiting from evaporator 46 passes through conduit 60 and mixes with the vaporous refrigerant passing from evaporator 54. The combined refrigerant flow is delivered through inlet port 24 of four-way valve 16 and exits from the valve via an outlet port 22.

A conduit 62 directs the gas delivered from valve 16 through a liquid accumulator 64. Accumulator 64 functions to insure that any liquid entrained in the refrigerant passing through conduit 66 is not transmitted to the vapor generating mechanism particularly when such mechanism is a reciprocating refrigerant compressor. The vaporous refrigerant exiting from accumulator 64 is directed via conduit 66 to the suction side of compression device 12.

Heretofore it has been known that a capillary type refrigerant expansion device functions to control the flow of refrigerant in accordance with changes in the refrigeration load on the evaporator via inherent self-compensating characteristics of such expansion device. Essentially, as the refrigeration load on the system is reduced, the refrigerant passing through evaporator 54 will not be entirely vaporized. Thus, liquid refrigerant will be entrained within the vaporous refrigerant passing into accumulator 64. The liquid refrigerant will be removed to prevent the delivery of liquid refrigerant to device 12. As the liquid refrigerant is removed from the refrigerant flow cycle, the refrigerant level within condenser 28 will decrease. Eventually, not all of the vaporous refrigerant passing through condenser 28 will be condensed. The non-condensed refrigerant will form bubbles within the liquid, resulting in a mixture of liquid and vaporous refrigerant flowing through conduit 34.

Under normal circumstances, the liquid-vapor mixture flowing through conduit 34 and thence to capillary type expansion device 50 is quite satisfactory since the vapor bubbles act to control the flow rate of refrigerant through the expansion device. Thus, at relatively low loads, the vaporous refrigerant entrained within the liquid refrigerant formed in condenser 28 functions to limit the flow of refrigerant through expansion device 50 thereby resulting in a self-compensating system. However, with the particular system described hereinabove, wherein two evaporators are served by a single high pressure refrigerant producing mechanism 12 and a single condenser 28, and wherein a first of the evaporators has a capillary type expansion device controlling the flow of refrigerant thereto and the other of the evaporators has a thermal expansion valve controlling the flow of refrigerant thereto, a problem occurs when refrigerant vapor is entrained within the liquid refrigerant formed in condenser 28. A thermal expansion valve cannot tolerate bubbles of vaporous refrigerant being entrained within the liquid refrigerant directed thereto. Essentially, the bubbles caused by the entrained vaporous refrigerant will substantially reduce the operating effectiveness of the thermal expansion valve. Thus, with systems of the type described, it is essential that some means be employed to permit the flow of a mixture of liquid and gaseous refrigerant to the capillary type expansion device, yet prevent the flow of a mixture of vaporous and liquid refrigerant to a thermal expansion device which requires substantially pure liquid refrigerant for proper operating performance.

To alleviate the foregoing problem and permit the proper functioning of system 10 particularly at low loads on evaporator 54, a separator 36 is utilized. The flow of refrigerant through separator 36 from conduit 34 results in substantially all of the heavier liquid refrigerant falling to the bottom of the separator whereat conduit 40 delivers such liquid refrigerant to thermal expansion valve 42. The remaining mixture of liquid and gaseous refrigerant being lighter than the heavier pure liquid refrigerant exits at the top of separator 36 and is delivered through conduit 38 to capillary type expansion device 50. Thus, each of the two types of expansion devices i.e. capillary type expansion device 50 and thermal expansion valve 42 has refrigerant directed thereto for achieving proper performance. As noted before, thermal expansion valve 42 is designed to operate most effectively when only liquid refrigerant is directed thereto. Likewise, performance of capillary type expansion device 50 is controlled by the amount of bubbles appearing in the refrigerant mixture directed thereto. The bubbles restrict flow of refrigerant through the capillary expansion device. As bubbles are formed at low refrigeration load conditions, it is obviously a desirable feature to restrain flow of refrigerant through the expansion device at low loads, thereby balancing the refrigeration load with the quantity of refrigerant circulated. Thus, by utilizing separator 36 each of the expansion devices performs as required within the overall system.

While a preferred embodiment of the present invention has been described and illustrated, the invention should not be limited thereto but may be otherwise embodied within the scope of the following claims.

I claim:

1. A refrigeration system including a first evaporator having a capillary type expansion device for controlling flow of refrigerant thereto and a second evaporator having a thermal expansion valve for controlling flow of refrigerant thereto, said system further comprising:

high pressure refrigerant vapor producing means having an inlet for receiving substantially vaporous refrigerant at a relatively low pressure and an outlet for discharging vaporous refrigerant at a relatively high pressure;

condenser means for receiving said high pressure vaporous refrigerant and for converting said vaporous refrigerant into a relatively high pressure mixture of liquid and vaporous refrigerant; and separator means for receiving said relatively high pressure mixture from said condenser means and for separating a substantial portion of said liquid refrigerant from said vapor liquid mixture;

discharge means connected to said separator means including a first conduit for delivering said separated liquid refrigerant to said thermal expansion valve and said second evaporator, and a second conduit for delivering the remainder of said vapor liquid mixture to said capillary expansion device and said first evaporator; and outlet means connected to said first and second evaporators for returning the refrigerant flowing therefrom to said vapor producing means.

2. A refrigeration system in accordance with claim 1 further including: an accumulator disposed in the path of flow of refrigerant through said outlet means for removing any liquid refrigerant from the flow of refrigerant delivered to said vapor producing means.

3. A method of operating a refrigeration system having a capillary expansion device controlling flow of refrigerant to a first evaporator having a relatively small refrigeration load served thereby and a thermal expansion device controlling flow of refrigerant to a second evaporator comprising the steps of:

generating a relatively high pressure refrigerant vapor;

condensing a substantial portion of the refrigerant vapor to form a mixture of liquid refrigerant and vaporous refrigerant;

separating a substantial portion of the liquid refrigerant from the liquid vapor refrigerant mixture;

directing the separated liquid refrigerant to the thermal expansion valve and thence to the second evaporator;

directing the unseparated liquid vapor refrigerant mixture to the capillary expansion device and thence to the first evaporator; and generating relatively high pressure refrigerant vapors from the refrigerant exiting the first and second evaporators for continuing the refrigeration cycle.

4. A method of operating a refrigeration system in accordance with claim 3 further including the step of:

accumulating any liquid refrigerant entrained within the refrigerant exiting from the first and second evaporators.

* * * * *